US005373874A

United States Patent [19]

Shieh

[11] Patent Number: 5,373,874

[45] Date of Patent: Dec. 20, 1994

[54] DISPENSING MECHANISM FOR VENDING MACHINE

[76] Inventor: Tzyy D. Shieh, Suite 1, 11F, 95-8 Chang Ping Road, Sec. 1, Taichung, Taiwan, Prov. of China

[21] Appl. No.: 948,213

[22] Filed: Sep. 21, 1992

[51] Int. Cl.[5] ..... B67C 3/26; B67C 3/34

[52] U.S. Cl. ..... 141/283; 141/271; 141/369; 222/129.1

[58] Field of Search ..... 141/250, 267, 268, 271, 141/281, 282, 283, 351, 360, 361, 362, 369, 370, 373, 377, 379, 380, 381; 222/129.1, 129.2, 129.3, 129.4; 312/319, 2, 326, 123, 127, 293.2; 224/278, 280, 281

[56] References Cited

U.S. PATENT DOCUMENTS

| | | | |
|---|---|---|---|
| 657,930 | 9/1900 | Feldkircher | 312/123 |
| 1,625,011 | 4/1927 | Wolfe et al. | 224/281 |
| 1,637,808 | 8/1927 | Armond et al. | 141/250 |
| 2,572,541 | 10/1951 | Thompson et al. | 222/129.3 |
| 3,398,805 | 8/1966 | Waller | 141/361 |
| 4,925,072 | 5/1990 | Masler et al. | 224/281 |

FOREIGN PATENT DOCUMENTS

| | | | |
|---|---|---|---|
| 399381 | 10/1933 | United Kingdom | 224/278 |

*Primary Examiner*—Henry J. Recla
*Assistant Examiner*—Steven O. Douglas

[57] ABSTRACT

In a fluid vending machine, a pivoting dispensing assembly comprises a housing having the form of a cylindrical sector, and a conformingly shaped platform rotatingly secured therein having a sectorial base plate and rectangular inner and outer sides. A spring disposed between the base plate of the platform and a bottom plate of the housing urges the platform towards a closed position therein. A user supplied container disposed on the base plate is filled with fluid dispensed through an aperture on a top plate of the housing. A switch on the housing in contact with the inner side of the platform when in the closed position shuts off the egress of fluid into the container should the user draw out the platform during a dispense cycle.

6 Claims, 3 Drawing Sheets

DISPENSING MECHANISM FOR VENDING MACHINE

BACKGROUND OF THE PRESENT INVENTION

The present invention relates to a dispensing assembly for fluid vending machines, and more particularly to a dispensing assembly having a platform rotatably secured within a housing in the vending machine which can be drawn outward so that a user supplied container can be readily accessed.

The pivoting dispenser assembly of the present invention is particularly well suited to fluid vending machines of the type which requires a user supplied container, such as vending machines for dispensing potable water or similar fluids that normally dispenser fluids in larger volumes than that commonly delivered in beverage vendors which also dispense cup type containers. As a user would be able to rotate the platform of the assembly out of the housing after the container therein was filled, the task of removing of the laden container without spillage is considerably reduced. Furthermore, the dispenser assembly of the present invention includes an electric switch which shuts off the egress of liquid into a container during a dispense cycle should a user draw out the platform before a selected volume of liquid is dispensed. This feature is useful for users which have containers of varying or indeterminate volume so as to avoid overflow.

SUMMARY OF THE PRESENT INVENTION

It is thus a first object of the present invention to provide a pivoting dispenser assembly comprising a housing secured into the front of the vending machine, having a sectorial base plate and rectangular inner and outer sides, which is rotatingly positioned within the housing. The platform is spring biased to withdraw into the housing. A user can pull out the platform and place a container onto the base plate thereof. A selected volume of fluid is disposed into the container through an aperture on an upper plate of the housing, after a dispense cycle is initiated in the conventional manner. A user can stop a dispense cycle by withdrawing the platform from the housing so as to actuate an electric switch on the housing in contact with the inner side of the platform.

A further object of the present invention is to provide a pivoting dispenser assembly as characterized which supports a filled container so as to facilitate the extraction thereof by a user without spillage or undue strain.

Yet another object of the present invention is to provide a pivoting dispenser as characterized which enables a user to stop a dispense cycle at any time so as fill containers of non-standard volume, or to initially acquire a relatively small amount of fluid for cleaning a container.

A more thorough understanding of the present invention will be attained by referring to a detailed description of the preferred embodiment provided below along with accompanying drawings.

DETAILED DESCRIPTION OF THE PREFERRED EMBODIMENT

Figure 1:
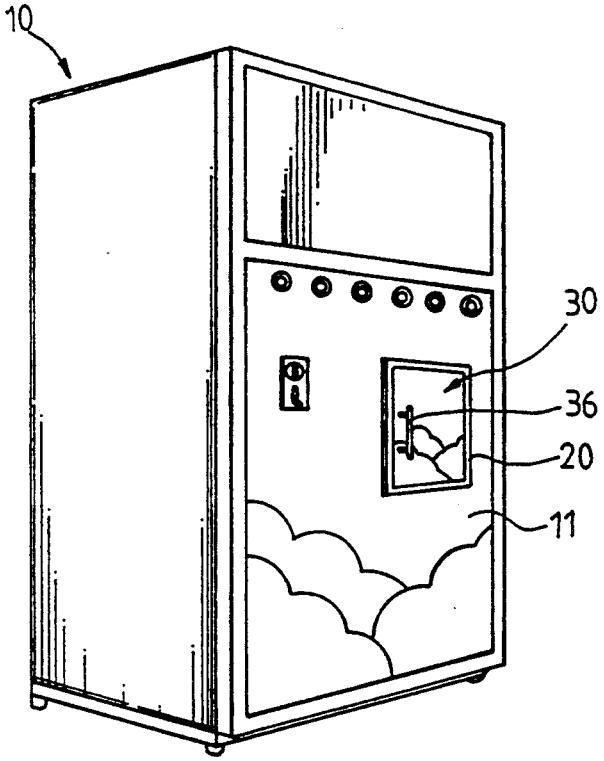
FIG. 1 is a perspective view showing a vending machine with a pivotable dispensing assembly in accordance with the present invention in a closed position.
Figure 2:
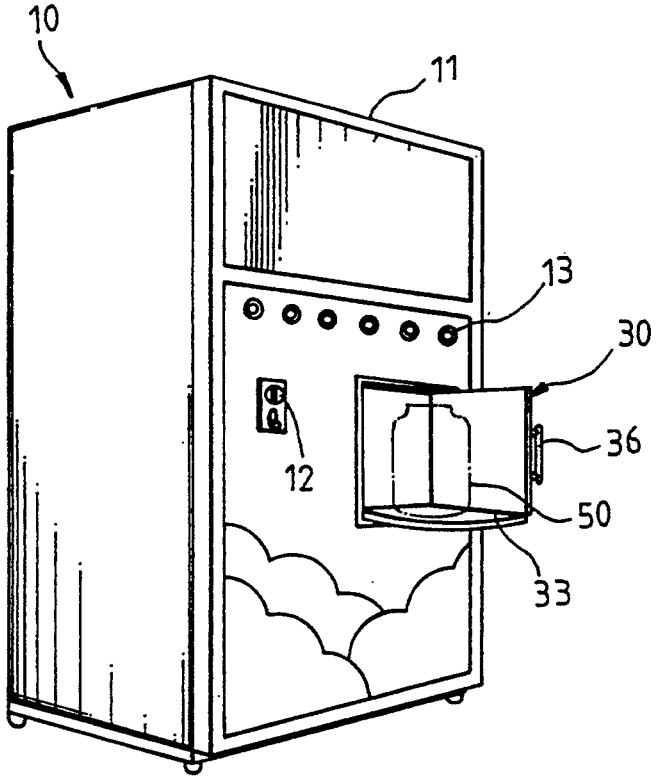
FIG. 2 is a perspective view of the vending machine with the pivotable dispensing assembly in an open position.
Figure 3:
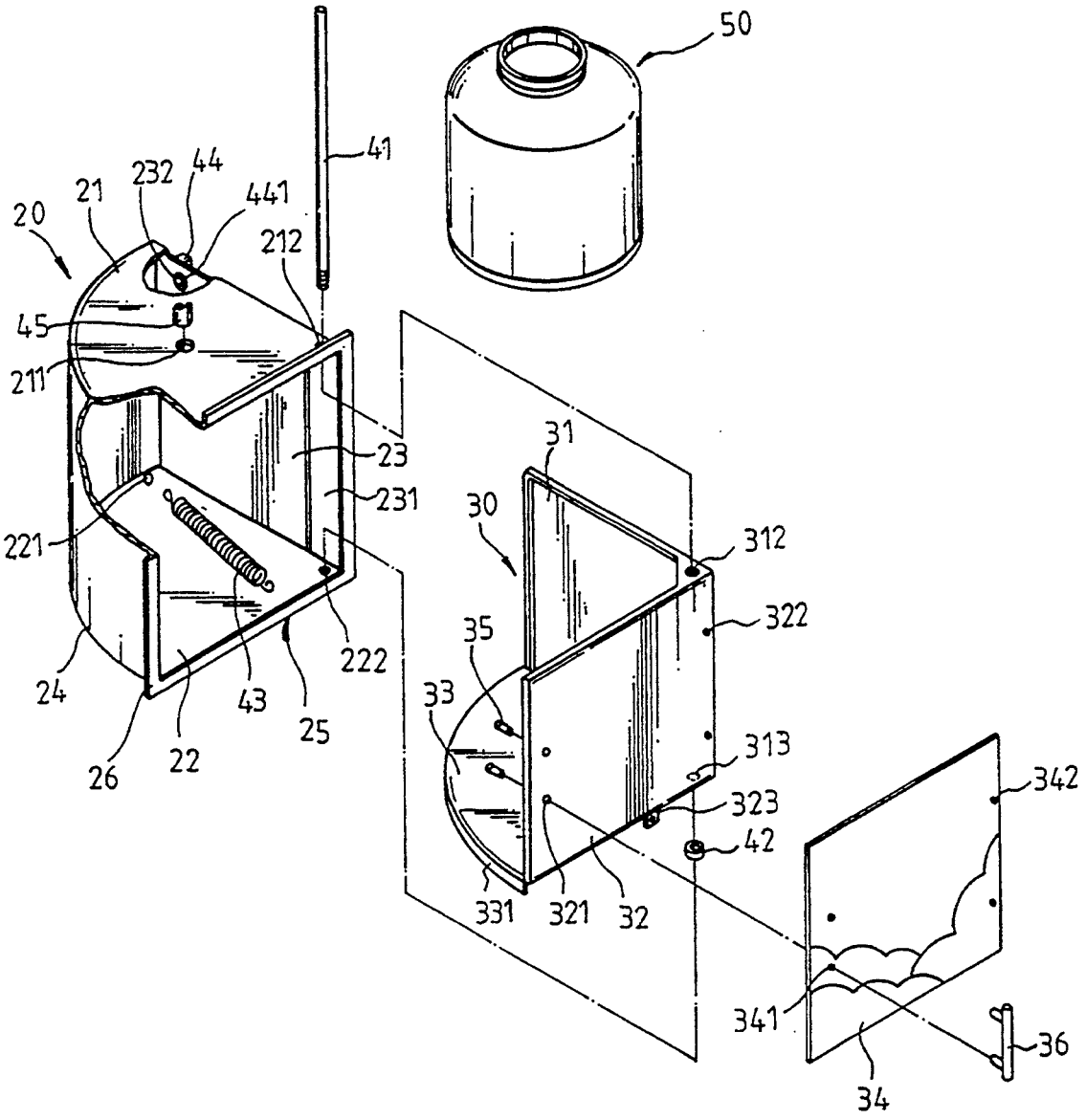
FIG. 3 is a disassembled view of the dispensing assembly of the present invention.

Referring to FIGS. 1 to 3 of the drawings, a vending machine 10 for potable water or the like includes a coin slot 12 for the insertion of tokens and selection switches 13 on the front panel 11 thereof. A pivotable dispensing assembly disposed within panel 11 comprises a housing 20 secured in an aperture in the panel and a platform 30 rotatably secured within the housing.

Housing 20 has a top plate 21 ,and bottom plate 22 of the general shape of a right angle circular sector, an arcuate side wall 24 of the general shape of a cylindrical sector, and a rectangular lateral plate 23. The upper and lower arcuate edges of side wall 24 adjoin respectively with the circumferential edges of top plate 21 and bottom plate 22. The upper and lower edges of lateral plate 23 adjoin with respective inner radial edges of the top and bottom plates. A rectangular flange 26 is formed around the opening of the housing for abutment against front panel 11, so as to facilitate mounting of the housing within the vending machine. A pair of aligned through holes 212, 222 are formed on respective top and bottom plates 21, 22 proximate the comers thereof opposite from the arcuate side wall 24.

Figure 4:
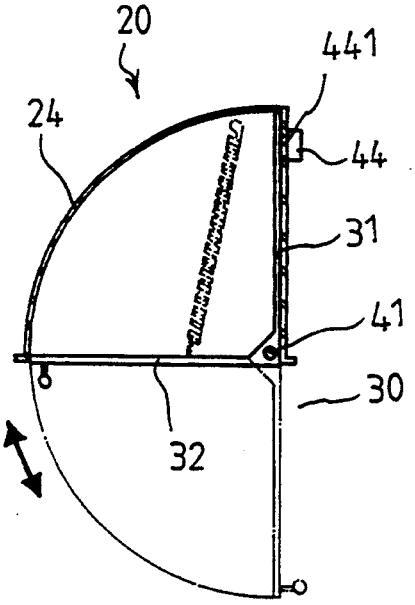
FIG. 4 shows the dispensing assembly in a closed position, and in an open position in phantom view.

Platform 30 has a lower base plate 33 of the general shape of a circular sector, and a rectangular inner side 31 and outer side 32. The lower edges of inner and outer side 31, 32 adjoin with respective radial edges of plate 33. An arcuate rim 331 depends from the circumferential edge of plate 33 and a holed lug 323 depends from a predetermined position on the lower edge of side 32. A web portion on an upper corner defined between the inner and outer sides 31, 32 has a first hole 312 formed thereon. An aligned second hole 313 is formed on a lower corner of plate 33. The platform is rotatingly secured within housing 20 by an elongate axle rod 41 that extends through the through holes 212, 222 thereof and the aligned first and second holes 312, 313 of the platform. In so doing, a space is defined between the base plate 33 of the housing and the bottom plate 22 of the housing wherein an annular spacer 42 is disposed therebetween with a lower section of axle rod 41 extending therethrough. A coil type tension spring 43 is disposed in this space, which is also surrounded peripherally by the depending rim 331. Spring 43 has a first hooked end engaged with a circular slot 221 formed on bottom plate 22 near the inner comer thereof and a second hooked end engaged with the holed lug 323 on the platform. Referring to FIG. 4, the spring urges the platform towards a closed position within the housing whereat the inner side 31 is in abutment with lateral plate 23.

The outer edge portion of lateral plate 23 has a rectangular recessed portion 231 formed therealong so as to not obstruct the rotation of the platform within the housing, which otherwise would block the adjoining edge portion of the inner and outer sides 31, 32.

An electric limit type switch 44 is secured to the outer side of lateral plate 23 near the upper, inner comer thereof. The switch has an actuator rod 441 which protrudes through an aperture 232 in the lateral plate for engagement with the side 31 of the platform when in the closed position.

A rectangular, external plate 34 is secured to the outer surface of side 32 by a pair of fasteners 35 which engage a handle 36 through aligned holes 341 and 321 formed respectively on plate 34 and side 32 near corresponding lateral edges thereof. Another two pairs of aligned holes 342 and 322 are also provided along the opposing edges of the respective plate and side for engagement with fasteners (not shown).

In operation, a user would first pull on handle 36 to pivotably withdraw platform 30 from housing 20 to an open position, as shown in phantom view in FIG. 4, and place a container 50 supplied by him or her on base plate 33. After allowing the platform 30 to return to the closed position within the housing under the bias of spring 43, the user would operate the vending machine in a conventional fashion, i.e. insert tokens and make a selection. A selected type and/or volume of liquid would then dispense through egress 45 into the container 50. The user subsequently draws out the platform and handily removes the container which now is filled with fluid. The flow of fluid into the container would be terminated during the dispensing cycle if the user were to draw the platform away from the closed position, wherein switch 44, under the control of actuator 441, shuts off the flow control mechanism of the vending machine in electrical communication therewith. This feature is advantageous for users having containers of indeterminate volume or that have volumes which do not correspond with one of the predetermined dispense volumes of the machine, so as to avoid overflow. A user may also choose to use this feature to extract a relatively small volume of fluid for cleaning a container perhaps prior to actual filling.

It should be understood that the above disclosure is to be construed not in a limitative sense in relation to the scope of the present invention but rather as being exemplary thereof, with the actual spirit and scope of the present invention being determined from the appended claims and their legal equivalents.

I claim:

1. In combination with a fluid vending machine for dispensing fluids such as potable water into a user supplied container, a dispensing assembly comprising:

a housing disposed in the front of said vending machine comprising a top plate and a bottom plate having generally the shape of a right angle circular sector, an arcuate side wall having generally the shape of a cylindrical sector, the upper and lower edges thereof adjoining with the circumferential edges of respective said top plate and said bottom plate, and a rectangular lateral plate, the upper and lower edges thereof adjoining respectively with a first radial edge of said top plate and said bottom plate, said top plate having an egress aperture formed therethrough for the intromission of a dispensed fluid into the interior of said housing;

a platform comprising a lower base plate for supporting said container having generally the shape of a right angled circular sector, a rectangular inner side adjoined along a lower edge thereof with a first radial edge of said base plate, a rectangular outer side adjoined along a lower edge thereof with a second radial edge of said base plate:

a hinge means for pivotably securing said platform in said housing;

a switch means for shutting the intermission of a dispensed fluid into said container when a user effects the outward rotation of said platform away from said closed position:

a spacing means for defining a space between said base plate and said bottom plate: and a spring means disposed in said space for urging said platform towards a closed position in said housing whereat said inner side plate approaches said lateral plate.

2. A dispensing assembly according to claim 1, wherein said switch means includes an electric limit type switch and a switch aperture formed in said lateral plate, said limit type switch having an actuator rod protruding through said switch aperture for engagement with said inner side of said platform when in said closed position.

3. A dispensing assembly according to claim 2, wherein said hinge means comprises: a pair of aligned through holes formed in respective said top plate and said bottom plate proximate comers thereof opposite said arcuate side wall;

a web portion in said platform formed in an upper corner defined between said inner side and said outer side thereof, said web portion having a first hole formed therein aligned with a second hole formed in a lower corner of said base plate:

an axle rod extending through said through holes and said first and said second hole aligned therewith.

4. A dispensing assembly according to claim 3, wherein said spring means comprises a tension type spring disposed in said space between said base plate and said bottom plate, a slot formed in said bottom plate engaged with a first hooked end of said spring, and a depending lug formed on a forward radial edge of said base plate engaged with a second hooked end of said spring.

5. A dispensing assembly according to claim 4, wherein said spacing means comprises a depending rim formed around the circumferential edge of said base plate and an annular spacer disposed around a section of said axle rod extending through said space.

6. A dispensing assembly according to claim 5, further comprising a handle secured to an outer surface of said outer side of said platform, and an exterior plate secured over the outer surface being clamped between the outer surface and handle.

* * * * *